United States Patent [19]

Heilmann

[11] Patent Number: 4,906,375

[45] Date of Patent: Mar. 6, 1990

[54] ASYMMETRICAL MICROPOROUS HOLLOW FIBER FOR HEMODIALYSIS

[75] Inventor: Klaus Heilmann, Neunkirchen, Fed. Rep. of Germany

[73] Assignee: Fresenius, AG, Fed. Rep. of Germany

[21] Appl. No.: 188,719

[22] Filed: Apr. 29, 1988

Related U.S. Application Data

[60] Continuation of Ser. No. 913,082, Sep. 29, 1986, abandoned, which is a division of Ser. No. 756,000, Jul. 17, 1985, abandoned.

[30] Foreign Application Priority Data

Jul. 14, 1984 [DE] Fed. Rep. of Germany ..... 3436331

[51] Int. Cl.[4] ..... D01D 5/247; B01D 39/16

[52] U.S. Cl. ..... 210/500.23; 210/500.27; 264/41; 264/49; 264/561; 264/209.1; 264/211.16; 264/233; 428/398

[58] Field of Search ..... 264/41, 49, 561, 209.1, 264/211.16, 233; 210/500.23, 500.27, 500.22, 500.41; 428/398

[56] References Cited

U.S. PATENT DOCUMENTS

| | | | |
|---|---|---|---|
| 3,615,024 | 10/1971 | Micheals | 264/41 |
| 3,691,068 | 9/1972 | Cross | 210/500.2 |
| 3,763,055 | 10/1973 | White et al. | 210/500.41 |
| 3,948,823 | 4/1976 | Lee et al. | 210/500.22 |
| 4,051,300 | 9/1977 | Klein et al. | 210/500.2 |
| 4,100,238 | 7/1978 | Shinomura | 264/49 |
| 4,286,015 | 8/1981 | Yoshida | 428/305 |
| 4,351,860 | 9/1982 | Yoshida | 427/246 |
| 4,432,875 | 2/1984 | Wrasidlo et al. | 210/500.41 |
| 4,545,910 | 10/1985 | Marze | 210/651 |

FOREIGN PATENT DOCUMENTS

| | | | |
|---|---|---|---|
| 0082433 | 3/1986 | European Pat. Off. . | |
| 55-106243 | 8/1980 | Japan . | |
| 60-58207 | 4/1985 | Japan | 210/500.41 |
| 61-46203 | 3/1986 | Japan | 210/500.41 |

*Primary Examiner*—Hubert C. Lorin
*Attorney, Agent, or Firm*—Omri M. Behr

[57] ABSTRACT

An asymmetric microporous hollow fiber for hemodialysis is made up of 90 to 99% by weight of a first hydrophobic polymer and 10 to 1% by weight of a second hydrophilic polymer. The fiber has a water adsorbing capacity of 3 to 10% and is produced by extruding a solution containing 12 to 20% by weight of the first polymer and 2 to 10% by weight of the second polymer, the rest being a solvent to give a continuous hollow structure with a wall, causing a precipitation liquor to act on said structure in an outward direction through the wall thereof with the full precipitation thereof and the concurrent dissolution and washing out of a part of said first polymer from said extruded structure and then washing out the dissolved out part of the pore-forming substance and the other organic components. Thereafter the fiber so produced is fixed in a washing bath.

24 Claims, 7 Drawing Sheets

ASYMMETRICAL MICROPOROUS HOLLOW FIBER FOR HEMODIALYSIS

This application is a continuation of application serial no. 913,082, filed 9/29/86, now abandoned, which is a division of application serial no. 756,000, filed 7/17,85, now abandoned.

BACKGROUND OF THE INVENTION

The present invention relates to asymmetrical microporous fibers, particularly for the treatment of blood, and made up of a first polymer which is hydrophobic and a second polymer which is hydrophilic. Furthermore the invention relates to a process for the manufacture of such fibers, in which the polymeric components are dissolved in a polar and aprotic solvent, the solution so produced is extruded through a spinnerette to form a hollow fiber structure into whose lumen a precipitant is introduced and the resulting hollow fiber is placed in a bath to free it of components that are able to be washed out.

DISCUSSION OF THE PRIOR ART

The U.S. Pat. No. 3,615,024 refers to asymmetrical hollow fibers that are manufactured exclusively from a hydrophobic polymer. As a consequence of this, such hollow fibers are no longer water-wettable and for this reason they either may not be allowed to to become completely desicated or they have to be kept filled with a hydrophilic liquid such as glycerol. Otherwise, every time the fibers are dried there is a further decrease in the ultrafiltration rate, because their minute pores become increasingly filled with air and are then no longer able to be wetted with water. The outcome of this is that the separation boundary is shifted after each drying out and does not in fact remain constant.

Furthermore the fibers described in this said U.S. patent made of hydrophobic polymers are not sufficiently stable and have a relatively poor yield point so that fibers manufactured in keeping with the patent are hard to process. Another point is that such a fiber will shrink after drying and does not possess a fine-pored structure but rather a coarse-pored finger structure with extensive vacuoles therein mitigating against stability, as has already been inferred in the description so far.

It is for this reason that the fibers covered in this US patent are not suitable for purposes of hemodialysis, because their particular structure and their hydrophobic properties make them hard to process after they have been extruded, and make a specialized treatment necessary before hemodialysis.

The U.S. Pat. No. 3,691,068 gives an account of a membrane that, although it may be used for dialysis, is basically merely a further development of the membrane as noted in the first said U.S. Pat. No. 3,615,024.

The fiber produced in keeping with this last-named patent undergoes a drying process to remove residual water therein, stemming from the process of manufacture, more or less completely. The outcome of this is that—as we have seen—the small pores become filled with air and for this reason are not able to play any part when the filter is used with water. It is only the large pores that are available for the water that is to be ultrafiltered, with the consequence that the rate of ultrafiltration as a whole is cut down and the solute separation properties of the membrane are altered. The above remarks also apply inasfar as it is a question of the mechanical properties of such a membrane and the processing thereof.

Another U.S. Pat., No. 4,051,300, describes a synthetic hollow fiber that may be used for industrial purposes (such as reverse osmosis and the like), but not however for hemodialysis. This fiber is manufactured from a hydrophobic polymer with a certain addition of a hydrophilic polymeric pore-forming substance. In view of its purpose of use such a fiber has a bursting pressure of 2000 psi (42.2 kg/su. cm) as dependent on the manner of production and the fiber structure. It is for this reason that although this fiber may successfully be used for reverse osmosis, it is not suitable for hemodialysis, in which the working conditions are quite different. In the case of hemodialysis the important criterion is essentially that the membrane produced have a high sieving coefficient and furthermore a high diffusity. These parameters are however not satisfactory in the case of the membrane of the U.S. Pat. No. 4,051,300 so that the membrane may not in fact be employed for hemodialysis.

The German Offenlegungsschrift specification No. 2,917,357 relates to a semipermeable membrane that may be made of polysulfone or other material. The fiber has not only an inner skin but furthermore and outer one so that the hydraulic permeability is markedly diminished. Owing to the hydrophobic structure, such a membrane is furthermore open to the objections noted earlier herein.

Lastly the German Offenlegungsschrift specification 3,149,976 is with respect to a macroporous hydrophilic membrane of a synthetic polymer as for example a polysulfone with a certain content of polyvinylpyrrolidone (PVP). In this respect the PVP level as to be at least 15% by weight of the casting solution and the membrane was to have a water uptake capacity of at least 11% by weight of the final membrane.

Due to this large residual amount of extractables, this fiber was only suitable for industrial and not for medical purposes, as may furthermore be seen from its structure and its high water absorbing capacity.

As already explained, state of the art hollow fibers are normally utilized for the industrial removal from water, as for example for reverse osmosis or ultrafiltration, or for separating gases.

ACCOUNT OF THE INVENTION

In keeping with the present invention however, a hollow fiber is to be created that may be used for hemodialysis, in which there are special requirements to be met.

The properties of such membranes in the form of hollow fibers are dependent on the type of process and the polymers used therein. Nevertheless it is extremely hard to make a fully appropriate choice of the starting products and the right conduct of the method of manufacture to be certain of producing a certain type of fiber, that is to say one with predetermined membrane properties. These desirable properties include:

(a) A high hydraulic permeability with respect to the solvent to be ultrafilterd. The fluid to be ultrafiltered, more particularly water, is in this respect to be able to permeate the membrane as efficiently as possible, that is to say with a high rate for a given surface area and for a given time at a low pressure. The permeability rate is in this connection dependent on the number and size of the pores and their length and on the degree to which wetting by the liquid takes place. It will be seen that in this respect a membrane with the largest possible number of pores of uniform size and with the lowest possible thickness is to be made available.

(b) A further point is that the membrane is to have a sharp separation characteristic, i.e. its pore size distribution is to be as uniform as possible in order to give a separation limit with respect to molecules of a certain size, that is to say of a certain molecular weight. In hemodialysis it is more specially desirable that the membrane have properties akin to those of the human kidney, that is to say so as to hold back molecules with a melecular weight of 45,000 and thereover.

(c) Furthermore the membrane is to have a satisfactory degree of mechanical strength to resist the pressures involved and must have an excellent stability.

As a rule this mechanical strength is inversely proportional to the hydraulic permeability or in other words the better the hydraulic permeability the poorer the mechanical strength of a membrane. To this end the asymmetrical membranes noted initially may incorporate a supporting membrane in addition to the separating or barrier layer, such supporting membrane on the one hand backing up the separating membrane of limited mechanical strength and on the other hand being generally without any effect on the hydraulic properties because of its having a substantially larger pore size. However the supporting member of such an asymmetrical capillary membrane frequently has such large pores that there are severe limits to any possible reduction of the thickness of the barrier layer, i.e. the separating properties, and more specially the hydraulic permeability, have so far left somewhat to be desired.

(d) A further property of considerable weight in connection with membranes to be utilized for hemodialysis is the "biocompatibility" factor, a term used in connection with dialysis to connote a freedom from any response of the body's immune system akin to the response to surfaces such as as those on connectors, material of the housing, casting compositions and dialysis membranes.

This response may express itself in an initial drop in the leukocyte count (leukopenia) and of the oxygen partial pressure ($pO_2$) followed by a slow recovery of these values and an activation of the complement system.

Such reactions have been described in connection with the use of regenerated cellulose as a dialysis membrane. The intensity of this reaction is dependent on the size of the active surface.

Therefore one purpose or object of the invention is to make such a further development of the hollow fiber of the sort described initially, that it has an excellent wettability while concurrently exhibiting a very low level of extractables.

As part of a further objective of the invention such a hollow fiber is at the same time to have a very good hydraulic permeability and an excellent mechanical strength.

A still further aim of the invention is to create such a hollow fiber that has an excellent biocompatibility.

In keeping with these and further objects that will become apparent from the ensuing account of the invention hereinafter, an asymmetric micro- porous hollow fiber for the treatment of blood, composed of a hydrophobic first polymer and a hydrophilic second polymer, is so made that it comprises 90% to 99% by weight of the first polymer and 10% to 1% by weight of the second polymer with a water absorption capacity of 3 to 10% by weight and is able to be produced by a process in which an extruded solution of 1% to 20% by weight of the first polymer and 2% to 10% by weight of the second polymer, the rest being solvent, with a solution viscosity of 500 to 3,000 cps, is precipitated from the inside to the outside. After such precipitation a part of the second polymer is dissolved out and a certain part of the solvent are washed out.

The hollow fiber in keeping with the present invention may be looked upon as a step forward in the art insofar as it has a very high level of hydraulic permeability. In fact, the hydraulic permeability of the fiber produced in conformity with the invention is increased so as to be higher than the permeability of a comparable hollow fiber membrane of regenerated cellulose by a factor of at least 10.

The hollow fiber membrane produced in the method of the present invention furthermore has an excellent biological compatibility. It causes practically no leukopenia. In addition, the highly satisfactory biocompatibility makes it possible for the amount of heparin administered to be lowered.

Lastly no apoxia occurs, that is to say there is no decrease in the oxygen partial pressure to values within the deficit range. Accordingly the hollow fiber membrane produced in the invention is very much more biocompatible than hollow fibers as currently offered commercially for hemodialysis and has an ameliorated hydraulic behavior.

The method of the invention may be based on the use of synthetic polymers that are readily soluble in polar, aprotic solvents and may be precipitated therefrom with the formation of membranes. When such precipitation takes place they are to lead to the production of an asymmetric, anisotropic membrane, which on the one side has a skin-like microporous barrier layer, and on the opposite side has a supporting membrane, that is used to improve the mechanical properties of this barrier layer, without thereby having any influence on the hydraulic permeability however.

Polymers that may be used as the membrane forming first polymer include:

Polysulfones, such a polyethersulfones and more specifically polymeric aromatic polysulfones, that are constituted by recurrent units of the formulas I and II:

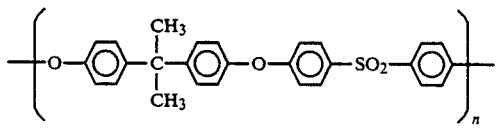

(I)

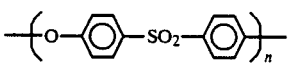

(II)

It will be clear from the formula I that here the polysulfone contains alkyl groups, more specially methyl groups in the chain, whereas the polyethersulfone of formula II only has aryl groups, that are joined together by ether and by sulfone bonds.

Such polysulfones or polyethersulfones, that come within the definition polyarylsulfones, are well known and are marketed under the trade name Udel by Union Carbide Corporation. They may be used separately or as blends.

Furthermore polycarbonates may be used, composed of linear polyesters of carboxylic acids and as marketed for example under the name of Lexan by General Electric Company.

Further materials that may be utilized are polyamides, that is to say polyhexamethyleneadipamides, as marketed for example by Dupont Inc under the trade name of Nomex.

Other polymers coming into question for use in the invention include for example PVC, polymers of modified acrylic acids and halogenated polymers, polyethers, polyurethanes and copolymers thereof.

However the use of polyarylsulfones and more particularly of polysulfones is preferred.

The hydrophilic second polymer may for example by a long-chained polymer, that contains recurrent inherently hydrophilic polymeric units.

Such hydrophilic second polymers may be polyvinylpyrrolidone (PVP), that has been used for a large number of medical purposes, as for example as a plasma expander. PVP consists of recurrent units of the general formula III (III)

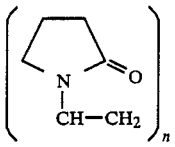

wherein n is a whole number of 90 to 4400.

PVP is produced by the polymerisation of N-vinyl-2-pyrrolidone, the degree of polymerisation being dependent on the selection of polymerisation method. For example PVP products may be produced with a mean molecular weight of 10,000 to 450,000 and may also be used for the purposes of the present invention. Such polysulfones are marketed by GAF Corporation under the trade connotations K-15 to K-90 and by Bayer AG under the trade name of Kollidon.

Another hydrophilic second polymer that may be used may be in the form of polyethyleneglycol and polyglycol monoesters and the copolymers of polyethyleneglycols with polypropyleneglycol, as for example the polymers that are marketed by BASF AG under the trade designations of Pluronic F 68, F 88, F 108 and F 127.

Still further materials that may be used are polysorbates, as for example polyoxyethylenesorbitane monooleate, monolaurate or monopalmitate. Such polysorbates are for example marketed under the trade name Tween, the preferred forms thereof being the hydrophilic Tween products as for example Tween 20, 40 and the like.

Finally water soluble cellulose derivatives may be employed such as carboxymethylcellulose, cellulose acetate and the like in addition to starch and its derivatives.

The preferred material is PVP.

The polar, aprotic solvents will generally be solvents in which the first polymers are readily soluble, that is to say with a solubility such that one may produce a solution with a concentration of fat least roughly 20% by weight of the synthetic polymer. Aprotic solvents belonging to this class are for example dimethylformamide (DMF), dimethylsulfoxide (DMSO), dimethylacetamide (DMA), N-methylpyrrolidone and mixtures thereof. Such aprotic solvents may be mixed with water in any quantity and consequently may be washed out of the fibers after precipitation. In addition to the pure polar, aprotic solvents it is furthermore possible to use mixtures thereof or mixtures of them with water, care being taken to observe the upper solubility limit of at least of about 20% by weight for the fiber forming polymer. As regards the conditions of precipitation, some advantage is to be gained by adding a small amount of water.

The first polymer is dissolved in the aprotic solvent at a rate of about 12 to 20 and more specially 14 to 18 or more limitedly about 16% by weight of the casting solution at room temperature, in which respect certain limitations with respect to viscosity, now to be explained, are observed in connection with the hydrophilic polymer. It has been seen from experience that in the case of a fiber forming polymer content in the solvent of under about 12% by weight, the hollow fibers formed are no longer strong enough so that in other words considerable trouble is experienced when they are further processed or used. On the other hand when the level of the fiber forming polymer in the solution is in excess of 20% by weight, the fibers are overly dense and this makes for less satisfactory hydraulic properties.

In order to ameliorate the formation of pores or to make it possible at all, such a solution having the fiber forming polymer in the above noted constituents will have a certain level of a hydrophilic, second polymer, which produces the desired pores when the predominantly hydrophobic fiber forming polymer is precipitated or coagulated. It is best, as noted earlier, for the second polymer to be used in an amount of about 2 to 10 and more specially 2.5 to 8%, by weight of the casting solution such level being compatible with the said viscosity limits for the composition of the solution. It is preferred for a certain amount of this water soluble polymer to be retained in the precipitated hollow fiber so that the same is more readily wetted. Consequently the finished hollow fiber may contain an amount of the second polymer that is equal to up to about 10% by weight and more specially 5 to 8% by weight of the polymeric membrane.

In keeping with the invention the solution containing the fiber forming polymer and the second polymer is to possess a viscosity of about 500 to 3,000 and more specially 1,500 to 2,500 cps (Centipoise) at 20° C., i.e. at room temperature. These viscosity values have been measured with a regular rotary viscosity measuring instrument such as a Haake instrument. The degree of viscosity, that is to say more specially the internal friction of the solution, is one of the more important parameters to be observed in running the process of the present invention. On the one hand the viscosity is to preserve or maintain the structure of the extruded hollow fiber configuration until precipitation takes place, and on the other hand it is not to obstruct the precipitation, that is to say the coagulation of the hollow fiber after access of the precipitating solution to the extruded viscous solution, in which respect use is best made of DMSO, DMA or a mixture thereof as a solvent. In this respect the experience made has been that by keeping to the viscosity range as noted above, one may be certain of producing hollow fiber membranes that have excellent hydraulic and mechanical properties.

The finished, clear solution, that is completely freed of undissolved particles by filtering it, is then supplied to the extrusion or wet-spinning spinnerette as described in what follows.

Normally a wet-spinning spinnerette is used that is generally on the lines of that disclosed in the U.S. Pat. No. 3,691,068. This spinnerette or nozzle has a ring duct with a diameter equaling the outer diameter of the hollow fiber. A spinnerette core projects coaxially into this duct and runs therethrough. In this respect the outer diameter of this core is generally equal to the bore diameter of the hollow fiber, that is to say the lumen diameter thereof. The precipitating liquor, which is to be described in what follows, is pumped through this hollow core so that it emerges from the tip of it and makes contact with the hollow fiber configuration that is made up of the extruded liquid. Further details of the system may be seen from the specification of the said U.S. Pat. No. 3,691,068 inasfar as the production of the hollow fiber is concerned.

The precipitating liquor is in the form of one of the above noted aprotic solvents in conjunction with a certain amount of non-solvent, more specially water, that on the one hand initiates the precipitation of the fiber building first polymer and on the other hand however dissolves the second polymer. A useful effect is produced if the aprotic solvent or mixture is the same as the solvent used in the solution containing the fiber forming polymer. In connection with the make-up of the precipitating liquor made of an organic, aprotic solvent or mixture of solvents and non-solvent, one has to take into account the fact that with an increment in the level of non-solvent the precipitating properties of the precipitating liquor become more pronounced so that the size of the pores formed in the membrane will become increasingly smaller and this offers a way of controlling the pore characteristics of the separating membrane by the selection of a given precipitating liquor. On the other hand the precipitating liquor is still to have a certain level of nonsolvent, equal to at least about 25% by weight, in order to make possible precipitation to the desired degree. In this respect a general point to be borne in mind is that the precipitating liquor will mix with the solvent of the solution containing the polymers so that the greater the distance from the inner face of the hollow fiber, the lower the water content in the aprotic solvent. Since the fiber itself however is to be fully precipitated before the washing liquor gets to it, the above limits will apply for the minimum water content in the precipitating liquor.

If the content of the non-solvent is low, as for example at a level of about 25% by weight, a membrane with coarse pores will be produced that lends itself to use as a plasma filter for example that only retains relatively large fractions in the blood such as erythrocytes.

It is preferred that the casting solution comprises at least 35% by weight of the non-solvent. A further point is that the amount of the precipitating liquor supplied to the polymer solution is as well a significant parameter for the conduct of the process in keeping with the present invention. This ratio is more importantly dependent on the dimensions of the wet-spinning spinnerette, that is to say the dimensions of the finished hollow fiber. In this respect it is a useful effect that on precipitation the dimensions of the fiber are not changed to be different to those of the hollow fiber configuration before precipitation but after extrusion. For this reason the ratios of the volumes used of precipitating liquor and of polymer solution may be in a range of between 1:0.5 and 1:1.25, such volumetric ratios being equal, given an equal exit speed (as is preferred) of the precipitating liquor and of the polymer solution, to the area ratios of the hollow fiber, i.e. the ring-area formed by the polymeric substance on the one hand and the area of the fiber lumen on the other.

It is best for so much precipitating liquor to be supplied to the extruded configuration directly upstream from the spinnerette that the inner or lumen diameter of the so extruded, but so far no precipitated, configuration generally corresponds in the dimensions of the ring spinnerette, from which the material is extruded.

It is useful if the outer diameter of the hollow fibers is equal to roughly 0.1 to 0.3 mm whereas the thickness of the membrane amounts to about 10 to 100 and more specially 15 to 50 or more limitedly to 40 microns. As we have seen above, the precipitation method is generally the same as the precipitation disclosed in the German Auslegeschrift specification No. 2,236,226 so that reference may be had thereto for further details. Consequently an asymmetrical capillary membrane is formed by the precipitating liquor acting in an outward direction on the polymer solution after issuing from the wet-spinning spinnerette. In keeping with the invention, the precipitation is generally terminated before the hollow fibre gets as far as the surface of a rinsing bath that dissolves out the organic liquid contained in the hollow fiber and finally fixes the fiber structure.

When precipitation takes place the first step is for the inner face of the fiber-like structure to be coagulated so that a dense microporous layer in the form of a barrier for molecules that are larger than 30,000 to 40,000 Daltons is formed.

With an increase in the distance from this barrier there is an increasing dilution of the precipitation liquor with the solvent contained within the spinning composition so that the precipitation properties become less vigorous in an outward direction. The consequence of this is that a coarse-pored, sponge-like structure is formed in an outward direction, that functions as a supporting layer for the inner membrane.

When precipitation takes place most of the second polymer is dissolved out of the spinning composition, whereas a minor fraction is retained in the coagulated fiber and may not be extracted therefrom. The dissolving out of the second polymer facilitates the formation of pores. A useful effect is produced if the greater part of the second polymer is dissolved out of the spinning composition, whereas the rest—as noted earlier on—is retained within the coagulated fiber.

Normally one will aim at dissolving out 60 to 95% by weight of the second polymer from the spinning composition so that only 40 to 5% by weight of the second polymer used will be left therein. It is more particularly preferred for less than 30% by weight of the originally used second polymer to be left therein so that the finished polymer contains 90 to 99% and more specially 95 to 98% by weight of the first polymer, the rest being second polymer.

As we have seen earlier the PVP is dissolved out of the spinning composition during the precipitation operation and remains in a dissolved condition in the precipitating liquor, something that again is not without an effect on the precipitation conditions, because the solvent properties of the second polymer have an effect on the overall characteristics of the precipitating liquor. Consequently the second polymer as well plays a part, together with the solvent components of the precipitating liquor, in controlling the precipitation reaction.

A point to be noted in this connection is that the method is best understood without any spinning draft. Draft in this connection means that the exit speed of the fiber-like structure from the ring spinnerette differs from (and is usually greater than) the speed at which the precipitated fiber is drawn off. This is responsible for stretching of the structure as it issues form the ring spinnerette and causes the precipitation reaction to take place in such a way that the pores formed are stretched in the draft direction and for this reason are permanently deformed. It has been seen in this respect that in the case of a fiber spun with a draft the ultrafiltration rate is very much slower than is the case with a fiber produced without such spinnerette draft. In this respect the invention is preferably so undertaken that the speed of emergence of the spinning composition from the spinnerette and the drawing off speed of the fiber produced are generally the same. There is then the beneficial effect that there is no deformation of the pores formed in the fiber or to a constriction of the fiber lumen and to a thinning out of the fiber wall.

A further parameter that is significant is the distance between the surface of the rinsing bath and the spinnerette, because such distance is controlling for the precipitation time at a given speed of downward motion, that is to say a given speed of extrusion. However the precipitation height is limited, because the weight of the fiber represents a certain limit, which if exceeded will cause the fiber structure, so far not precipitated, to break under its own weight. This distance is dependent on the viscosity, the weight and the precipitation rate of the fiber. It is best for the distance between the spinnerette and the precipitating bath not to be greater than about one meter.

After precipitation the coagulated fiber is rinsed in a bath that normally contains water and in which the hollow fiber is kept for up to about 30 minutes and more specially for about 10 to 20 minutes for washing out the dissolved organic constituents and for fixing the microporous structure of the fiber.

After that the fiber is passed through a hot drying zone.

Then the fiber is preferably texturized in order to improve the exchange properties thereof.

After this there is a conventional treatment of the fiber so as produced, that is to say winding onto a bobbin, cutting the fibers to a desired length and manufacture of dialyzers from the tufts of the cut fiber.

On its inner face the fiber manufactured in keeping with the present invention has a microporous barrier layer, that has a pore diameter of 0.1 to 2 microns. Next to this barrier layer on the outside thereof there is a foam-like supporting structure, that is significantly different to the lamellae-like structures of the prior art.

In other respects the dimensions of the fiber as so produced are in line with the values given above.

The semipermeable membrane produced in keeping with the invention has a water permeability of about 30 to 600 ml/h per sq. meter×mm Hg, and more specially about 200 to 400 ml/h per sq. meter×mm Hg.

Furthermore the hollow fiber produced in keeping with the instant invention has a water absorption capacity of 3 to 10 and more specially 6 to 8% by weight. The water absorption capacity was ascertained in the following manner.

Water-vapor saturated air is passed at room temperature (25° C.) through a dialyzer fitted with hollow fibers as produced in the invention and in a dry condition. In this respect air is introduced under pressure into a water bath and after saturation with water vapor is run into the dialyzer. As soon as a steady state has been reached, it is then possible for the water absorption capacity to be measured.

The clearance data were measured on fibers in keeping with the invention for an active surface of 1.25 sq. meters in line with DIN 58,352. In the case of a blood flow rate of 300 ml/minute in each case the clearance for urea is between 200 and 290 or typically 270, for creatinine and phosphate between 200 and 250, typically about 230, for vitamin $B_{12}$ between 110 and 150, typically 140 and for inulin between 50 and 120, typically 90 ml/minute.

Furthermore the membrane of the invention has an excellent separation boundary. The sieving coefficients measured are 1.0 for vitamin $B_{12}$, about 0.99 for inulin, 0.5 and 0.6 for myoglobin and under 0.005 for human albumin. It will be seen from this that the fiber produced in keeping with the invention is more or less exactly in line with a natural kidney with respect to its separating properties (sieving coefficient).

Further useful effects, working examples and details of the invention will be gathered from the following account of possible forms thereof using te figures.

LIST OF THE DIFFERENT VIEWS OF THE FIGURES

DETAILED ACCOUNT OF WORKING EXAMPLES OF THE INVENTION

The examples explain the invention. In the absence of any statement to the contrary, the percentages are by weight.

EXAMPLE 1

A wet-spinning polymer solution was prepared containing 15% by weight of polysulfone, 9% by weight of PVP (MW: 40,000), 30% by weight of DMA, 45% by weight of DMSO and 1% by weight of water. This solution was freed of undissolved matter.

The solution so prepared was pumped to a wet-spinning spinnerette, that at the same time was supplied with a precipitating liquor in the form of a mixture of 40% by weight of water and 60% by weight of 1:1 DMA/DMSO at 40C.

The ring spinnerette had an outer diameter of the orifice of about 0.3 mm and inner diameter of about 0.2 mm so that it was generally in line with the dimensions of the hollow fiber.

The hollow fiber produced had an inner face with a microporous barrier layer of about 0.1 micron next to an open-pored, sponge structure.

Figure 1B:
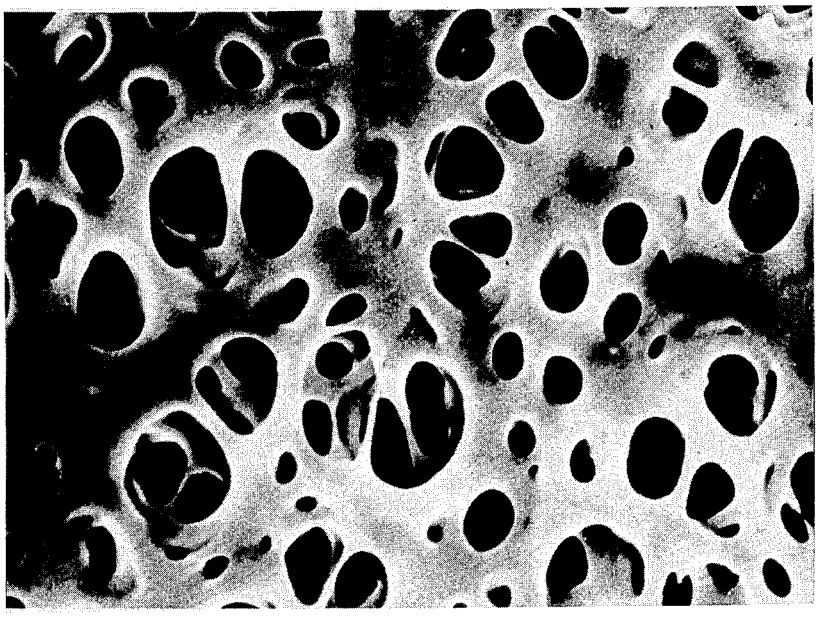
FIG. 1 is a magnified view of part of a section through the wall of a hollow fiber.
Figure 1A:
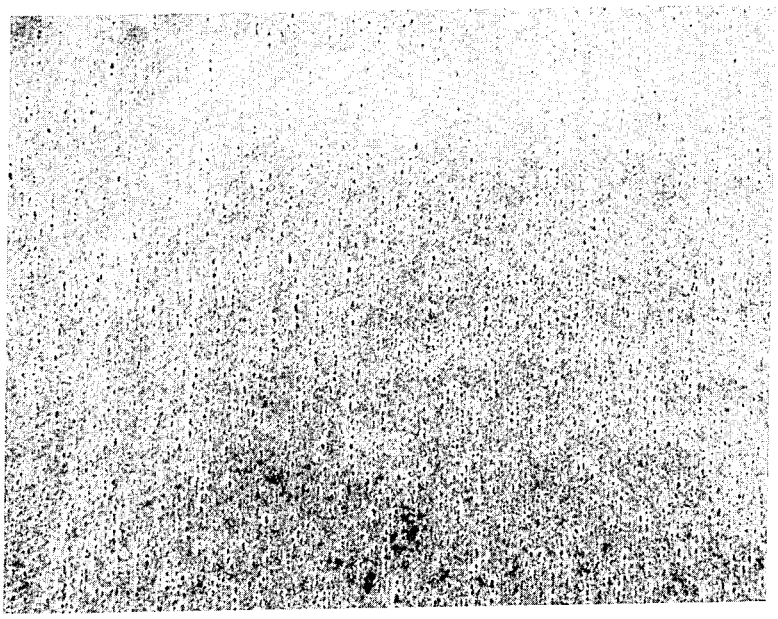

In FIG. 1 the reader will see magnified sections of the membrane produced, FIGS. 1*a* showing the inner face or barrier layer with a magnification of 10,000 and FIG. 1*b* showing the outer face with a magnification of 4,500.

This membrane still contained PVP so that it was readily wetted by water.

EXAMPLE 2

The membrane as produced in example 1 was tested with respect to permeability. It was found that the permeability for water is very high and for this membrane there was a value of about 210 ml/h sq. meter × mm Hg.

For blood the ultrafiltration coefficient was however lower, because as is the case with all synthetic membranes a so-called secondary membrane is formed (though to a lesser degree than in the prior art) degrading the hydraulic properties. This secondary membrane is normally composed of proteins and lipoproteins, whose overall concentration in the blood has an effect on the amount that may be filtered, and obstructs flow through the capillaries.

The ultrafiltration coefficients were measured using the method given in Int. Artif. Organ. 1982, pages 23 to 26. The results will be seen in FIG. 4.

The clearance data were ascertained in the lab with aqueous solutions in line with DIN 58,352 (inulin with human plasma). This gave the relation to be seen in FIG. 2 between clearance and blood flow (without filtration amount).

Figure 2:
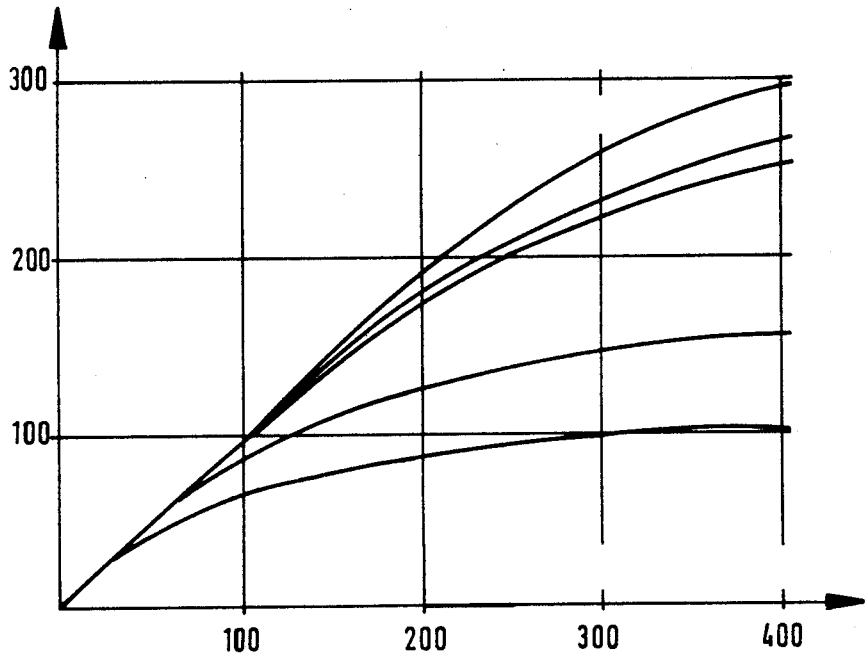
FIG. 2 is a graph to show clearance as function of blood flow rate in a fiber of the invention.
Figure 3:
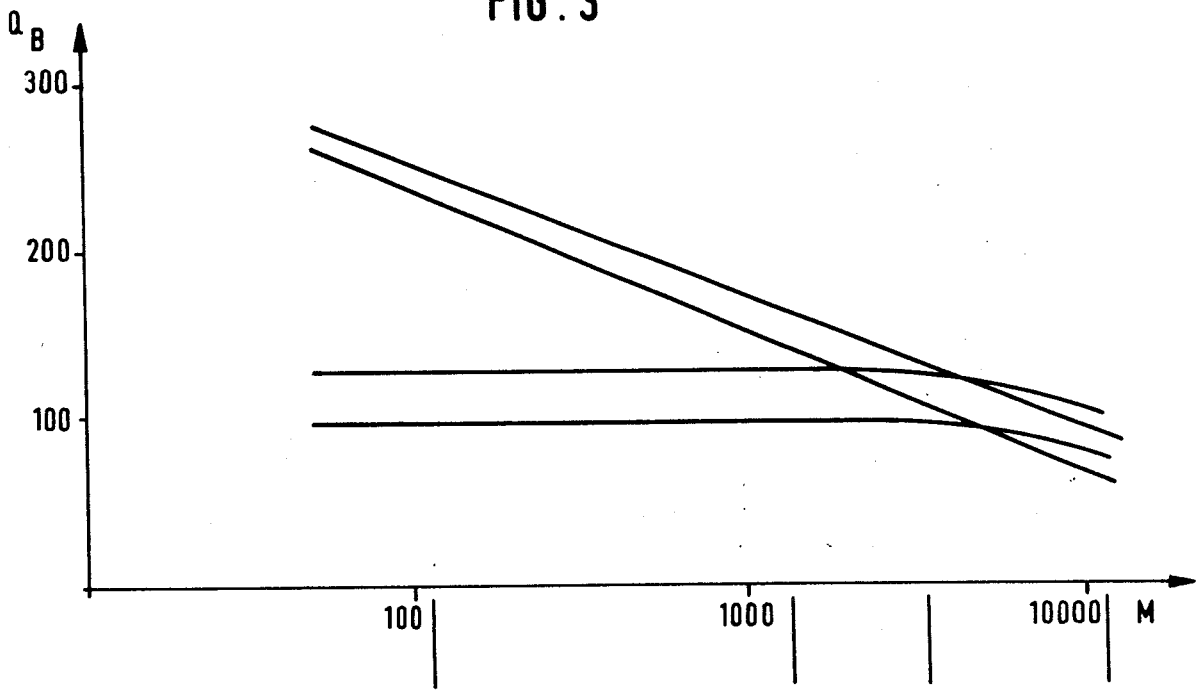
FIG. 3 is an elimination graph for molecules of different molecular weight as a function of blood flow rate.

At a blood flow rate of 300 ml/min the following elimination graph may be plotted, that is increased when there is an additional filtrate flow of 60 ml/min (HDF treatment). For comparison the net filtration graph has been plotted for $Q_B$=300 ml/min and $Q_F$=100 ml/min together with $Q_B$=400 ml/min and $Q_F$130 ml/min (FIG. 2).

It is only in the case of molecules with weights above those of inulin that the elimination with HF (hemofiltration) is greater than with HD (hemodialysis) using the fibers produced in the invention.

Figure 4:
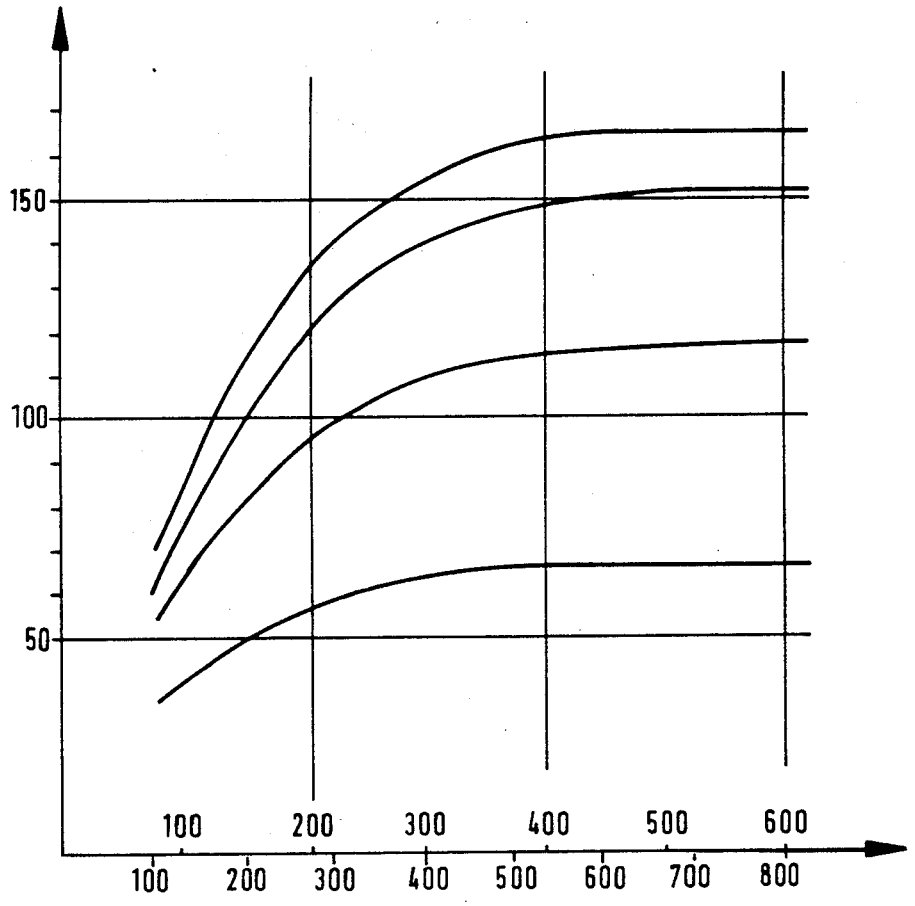
FIG. 4 is a graph with respect to ultrafiltration to show changes in the filtrate flow rate as a function of the transmembrane pressure.

The filtrate flow rate possible with a constant blood flow rate is given as a function of the TMP (transmembrane pressure) in FIG. 4.

It will be seen from this FIG. 4 that the filtrate flow continues to rise with an increasing TMP till a maximum level is reached. The increase in the blood viscosity is then so pronounced that a further increase in the TMP does not lead to any further increase in the filtrate rate.

On departing from the given figures (hematocrit 28% and protein 6%) these levels will be reached even at lower TMP figures (for higher blood figures) or, respectively, at a higher TMP (for smaller blood values). The degree to which this is of practical importance will be seen from FIGS. 5 and 6.

Figure 6:
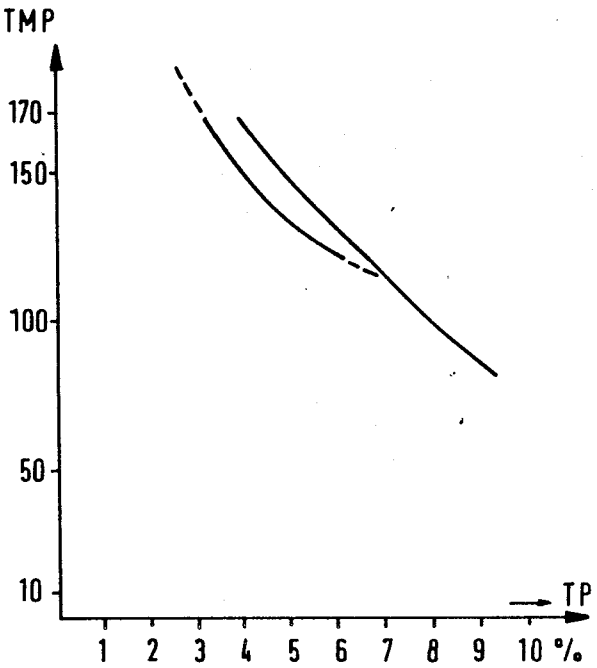
FIG. 6 is a graph to show changes in filtrate flow rate as a function of the protein content.
Figure 5:
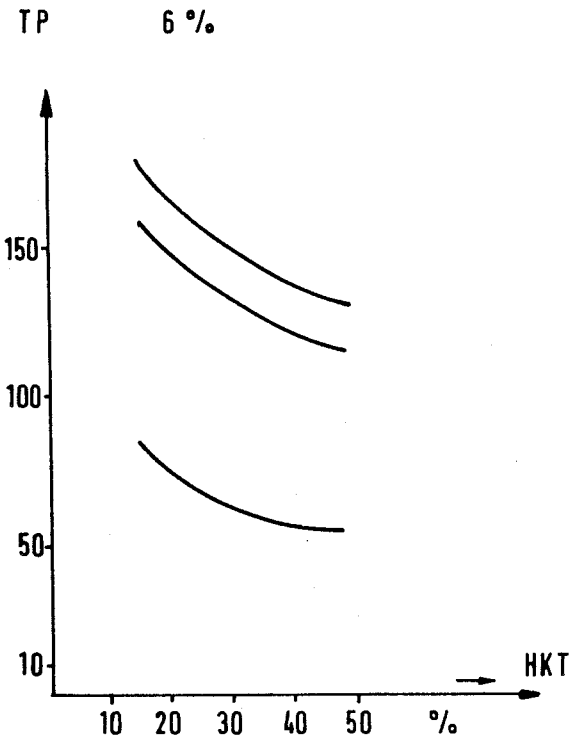
FIG. 5 is a graph to show changes in filtrate flow rate as a function of the hematocrit value.

In this respect FIG. 5 shows filtrate rate as a function of hematocrit and FIG. 6 shows filtrate rate as a function of the protein content for a hollow fiber produced by the process of the invention.

At a blood flow rate of 300 ml/min and a filtrate rate of 150 ml/min there is an increase—as may be seen from the figures—in the hematocrit value and the total protein of 28% and 6% (arterial) respectively to 56% and 12% (venous) respectively.

EXAMPLE 3

The fiber produced in example 1 has excellent properties when used in vivo.

Figure 7:
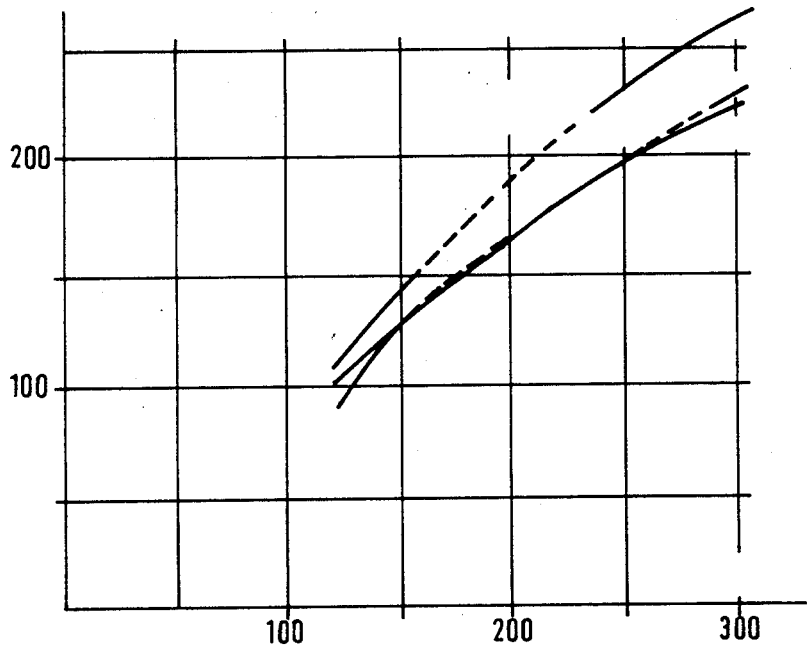
FIG. 7 is a graph of clearance data for urea, creatinine and phosphate.

It will be seen from FIG. 7 what clearances are possible with the fiber produced in the invention for urea, creatinine and phosphate.

On stepping up the filtrate rate from 0 ml/min to 50 ml/min the increase in clearance at $Q_B$=200 ml/min was

| | |
|---|---|
| 2% | for urea |
| 3% | for creatinine |
| 4% | for phosphate |
| 8% | for inulin |
| 40% | for beta-microglobulin |

An increase in the total clearance by additional filtration will only serve a useful purpose if the substances to be eliminated have higher molecular weights than the traditional "medium molecules".

The stability of clearance was also test in various research center. The results are given in the following table I

TABLE I

| | Example center A | | Example Center B | |
|---|---|---|---|---|
| | t = 20 min | t = 90 min. | Start HD | HD end |
| Urea | 261 | 269 | 148 | 133 |
| Clearance | 260 | 271 | 163 | 149 |
| | 261 | 265 | 140 | 137 |
| | 245 | 252 | 168 | 171 |
| | 282 | 267 | 168 | 127 |
| | 277 | 266 | 184 | 133 |
| | 275 | 268 | 182 | 148 |
| ∅ = | 266 ± 13 | 265 ± 6 | 165 ± 16 | 143 ± 15 |
| Creatinine | 222 | 219 | 137 | 140 |
| Clearance | 225 | 223 | 164 | 155 |
| | 231 | 232 | 133 | 145 |
| | 235 | 260 | 142 | 156 |
| | 269 | 257 | 150 | 141 |
| | 239 | 242 | 152 | 138 |
| | 214 | 233 | 137 | 166 |
| ∅ = | 234 ± 18 | 238 ± 16 | 145 ± 11 | 149 ± 10 |
| Phosphate | | | 118 | 132 |
| Clearance | | | 154 | 150 |
| | | | 137 | 143 |
| | | | 146 | 105 |
| | | | 141 | 114 |
| | | | 124 | 150 |
| | | | 166 | 156 |
| | | ∅ = | 141 ± 17 | 136 ± 20 |

∅ = mean value

Figure 8:
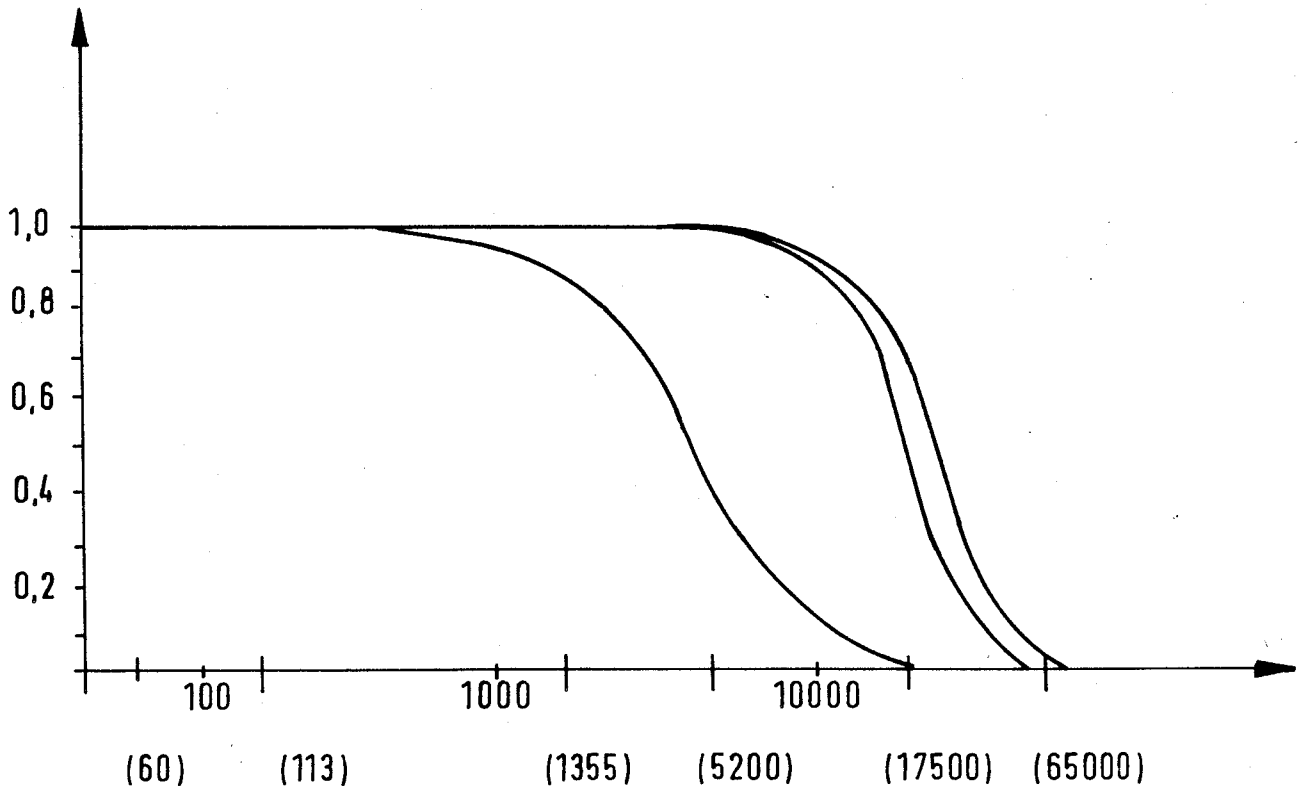
FIG. 8 is a graph of the sieving coefficients for molecules of different weights.

It will be seen from this that clearance is practically constant over the duration of treatment, the differences being within normal error deviations Finally in FIG. 8 the changes in sieve coefficient as a function of molecular weight are to be seen. This will make it clear that the fibers produced using the method of the invention have nearly the same properties as a natural kidney and considerably outdo conventional membranes of the prior art.

I claim:

1. An asymmetric microporous wettable hollow fiber, consisting essentially of an inner barrier layer and an outer foam-like supporting structure said fiber comprising a hydrophobic first organic polymer in an amount equal to 90 to 99% by weight and 10 to 1% by weight of polyvinyl pyrrolidone which is produced by the following steps:

(a) wet spinning a polymer solution made up of a solvent, of 12 to 20% by weight of the first said polymer and of 2 to 10% by weight of the polyvinyl pyrrolidone, said solution having a viscosity of 500 to 3,000 cps, through a ring duct of a spinnerette having an external ring duct and an internal hollow core, (b) simultaneously passing through said hollow internal core a precipitant solution comprising an aprotic solvent in conjunction with at least 25% by weight of a nonsolvent which acts in an outward direction on the polymer solution after issuing from the spinneret (c) casting into an aqueous washing bath, said spinnerette and the upper surface of said washing bath being separated by an air gap, said air gap being so provided that full precipitation of components will have occurred before the precipitated polymer solution enters said washing bath thereby, (d) dissolving out and washing away a substantial portion of the polyvinyl pyrrolidone and of the said solvent, to form a fibre having a high clearance rate according to DIN 58352, of 200–290 ml/min for urea and 200–250 ml/min for creatinine and phosphate, at a blood flow rate of 300 ml/min., for fibres having 1.25 $m^2$ of active surface.

2. An asymmetric microporous wettable hollow fiber according to claim 1 wherein said hydrophobic first polymer is selected from the group consisting of a polyarylsulfone, a polycarbonate, a polyamide, a polyvinyl chloride, a modified acrylic acid polymer, a polyether, a polyurethane and a copolymer thereof.

3. An asymmetric microporous wettable hollow fiber according to claim 2 wherein said first hydrophobic polymer is selected from the group consisting of polysulfone and a polyethersulfone.

4. An asymmetric microporous wettable hollow fiber according to claim 1 wherein said polyvinyl pyrrolidone has a mean molecular weight of 10,000–450,000.

5. An asymmetric microporous wettable hollow fiber according to claim 1 containing 95 to 98% by weight of the first said polymer, the rest being said second polymer.

6. An asymmetric microporous wettable hollow fiber according to claim 1 having a water absorption capacity equal to 3 to 10% of the weight of the hollow fiber.

7. An asymmetric microporous wettable hollow fiber according to claim 6 wherein said water absorption capacity is equal to 6 to 8% by weight.

8. An asymmetric microporous wettable hollow fiber according to claim 1, wherein said membrane comprises a water permeability of 200–400 ml/h per sq. meter X mmHg.

9. An asymmetric microporous wettable hollow fiber according to claim 8, wherein said membrane comprises a microporous barrier layer comprising pores with a pore diameter of 0.1–2 microns.

10. An asymmetric microporous wettable hollow fiber according to claim 1, wherein the clearance of urea is about 270 ml/min, creatinine and phosphate each about 230 ml/min, Vitamin $B_{12}$ about 140 ml/min and inulin about 90 ml/min.

11. An asymmetric microporous wettable hollow fiber according to claim 1 said material having a high rate of water permeability of about 30–60 ml/h per sq. meter × mmHg.

12. An asymmetric microporous wettable hollow fiber according to claim 1 said material having a high clearance rate according to DIN 58352 of 110–150 ml/min for Vitamin $B_{12}$ at a blood flow rate of 300 ml/min.

13. An asymmetric microporous wettable hollow fiber according to claim 1 said material having a high clearance rate according to DIN 58352 of 50–120 ml/min for inulin at a blood flow rate of 300 ml/min.

14. An asymmetric microporous wettable hollow fiber according to claim 1 said material having a high sieving coefficient of 1.0 for Vitamin $B_{12}$.

15. An asymmetric microporous wettable hollow fiber according to claim 1 said material having a high sieving coefficient of about 0.99 for insulin.

16. An asymmetric microporous wettable hollow fiber according to claim 1 said material having a high sieving coefficient of 0.5–0.6 for myoglobin.

17. An asymmetric microporous wettable hollow fiber according to claim 1 said material having a high sieving coefficient of under 0.005 for human albumin.

18. An asymmetric microporous wettable hollow fiber, consisting essentially of an inner barrier layer and an outer foam-like supporting structure said fiber comprising a hydrophobic first organic polymer in an amount equal to 90 to 99% by weight and 10 to 1% by weight of polyvinyl pyrrolidone said fibre having the following characteristics:

(a) a high rate of water permeability of about 30–600 ml/h per sq. meter per mmHg, (b) a high clearance rate according to DIN 58352, of 200–290 ml/min for urea, 200–250 ml/min for Vitamin $B_{12}$ and 50–120 ml/min for inulin, at a blood flow rate of 200–250 ml/min creatinine and phosphate, 300 ml/min., for fibres having 1.25 $m^2$ of active surface and (c) high sieving coefficients of 1.0 for Vitamin $B_{12}$, about 0.99 for inulin, 0.5–0.6 for myoglobin and under 0.005 for human albumin.

19. An asymmetric microporous wettable hollow fiber according to claim 18 wherein said hydrophobic first polymer is selected from the group consisting of a polyarylsulfone, a polycarbonate, a polyamide, a polyvinyl chloride, a modified acrylic acid polymer, a polyether, a polyurethane and a copolymer thereof.

20. An asymmetric microporous wettable hollow fiber according to claim 18, wherein said membrane comprises a water absorption capacity of 3–10% by weight.

21. An asymmetric microporous wettable hollow fiber according to claim 20, wherein said membrane comprises a water absorption capacity of 6–8% by weight.

22. An asymmetric microporous wettable hollow fiber according to claim 18, wherein said membrane comprises a water permeability of 200–400 ml/h per sq. meter per mmHg.

23. An asymmetric microporous wettable hollow fiber according to claim 18, wherein said membrane comprises a microporous barrier layer comprising pores with a pore diameter of 0.1–2 microns.

24. An asymmetric microporous wettable hollow fiber according to claim 18, wherein the clearance of urea is about 270 ml/min, creatinine and phosphate each about 230 ml/min, Vitamin $B_{12}$ about 140 ml/min and inulin about 90 ml/min.

* * * * *

UNITED STATES PATENT AND TRADEMARK OFFICE

CERTIFICATE OF CORRECTION

PATENT NO. : 4,906,375

DATED : March 6, 1990

INVENTOR(S) : Heilmann

It is certified that error appears in the above-indentified patent and that said Letters Patent is hereby corrected as shown below:

Column 14, line 32, claim 18, delete "200-250", insert in place thereof -- 110-150--, line 33-34, delete "at a blood flow rate of"

line 35, immediately before "300" insert "at a blood flow rate of"

Signed and Sealed this

Fourteenth Day of September, 1993

Bruce Lehman

*Attest:*

BRUCE LEHMAN

*Attesting Officer*

*Commissioner of Patents and Trademarks*